US006102599A

United States Patent [19]

Pierpont

[11] Patent Number: 6,102,599

[45] Date of Patent: Aug. 15, 2000

[54] COSMETIC CONTAINER WITH FRICTIONALLY COOPERATING MEMBERS

[75] Inventor: Robert L. Pierpont, Meriden, Conn.

[73] Assignee: Rexam Cosmetic Packaging, Inc., Torrington, Conn.

[21] Appl. No.: 09/212,803

[22] Filed: Dec. 16, 1998

[51] Int. Cl.[7] ..... B43K 21/08

[52] U.S. Cl. ..... 401/78; 401/74; 401/63

[58] Field of Search ..... 401/61, 62, 74, 401/75, 77, 78, 80, 84, 86, 87, 117, 63

[56] References Cited

U.S. PATENT DOCUMENTS

| | | | |
|---|---|---|---|
| 2,072,662 | 3/1937 | Abbotts | 401/74 |
| 2,504,490 | 4/1950 | Broder | 401/78 |
| 3,298,509 | 1/1967 | Hultgren . | |
| 3,380,795 | 4/1968 | Gruska . | |
| 3,547,551 | 12/1970 | Gruska . | |
| 4,514,102 | 4/1985 | Ackerman et al. . | |
| 4,690,578 | 9/1987 | Idec et al. . | |
| 5,597,252 | 1/1997 | Ito et al. . | |
| 5,746,530 | 5/1998 | Oota | 401/63 |
| 5,938,358 | 8/1999 | Joulia | 401/78 |
| 5,984,552 | 11/1999 | Ackermann et al. | 401/78 |

FOREIGN PATENT DOCUMENTS

| | | | |
|---|---|---|---|
| 80413 | 7/1992 | Japan | 401/78 |

*Primary Examiner*—Steven O. Douglas
*Assistant Examiner*—Khoa Huynh
*Attorney, Agent, or Firm*—Alston & Bird LLP

[57] ABSTRACT

A cosmetic container having concentrically arranged tubular members which frictionally cooperate to achieve the desired torque. The cosmetic container includes a cosmetic carrier and an inner sleeve. The cosmetic carrier includes a pair of outwardly extending radial protrusions and a pair of carrier lugs. The inner sleeve includes a pair of longitudinal channels for receiving the carrier lugs and a pair of longitudinal slots for cooperating with the radial protrusions. The radial protrusions are wider than the corresponding longitudinal slot and only a portion thereof is received within the longitudinal slot. Other portions frictionally engage resilient borders of the inner sleeve defining the longitudinal slot.

23 Claims, 5 Drawing Sheets

COSMETIC CONTAINER WITH FRICTIONALLY COOPERATING MEMBERS

FIELD OF THE INVENTION

The present invention is directed to a cosmetic container having the desired amount of torque and, more specifically, to a cosmetic container having a cosmetic carrier and an inner sleeve which are configured to create the desired drag between the concentric members.

BACKGROUND OF THE INVENTION

Cosmetic containers include concentrically arranged tubular members which rotate relative to one another to propel the cosmetic housed therein for application and to retract the cosmetic for storage. The cosmetic is extended and retracted due to relative rotational movement between the concentric tubular members.

It is desirable for cosmetic containers to possess a predetermined swivel torque so that the container has a certain "feel" to it, rotating freely due to its relatively low swivel torque but having enough "resistance" or torque to feel "sturdy". The torque can be adjusted by adjusting the ease at which the concentric members are permitted to rotate relative to one another.

Conventional lipstick containers include a cosmetic carrier, a tubular inner sleeve, a tubular outer sleeve and a protective outer shell. The cosmetic carrier supports the lipstick and is generally configured as a sleeve having radially extending lugs on opposing sides and is received within the inner sleeve. The inner sleeve defines longitudinally extending channels on opposing sides wherein the lugs of the cosmetic carrier extend therethrough. An outer sleeve which defines a pair of continuous helical channels is positioned about the inner sleeve wherein the lugs of the cosmetic carrier are configured to be received and to traverse along the length of the helical channels.

This results in the cosmetic carrier being moved upwardly and downwardly as the lugs traverse the length of the helical channels when a bottom portion of the inner sleeve is rotated. In operation, a bottom portion of the inner sleeve extends beyond the bottom of the outer sleeve and is secured to a baseshell of the protective cover. The user rotates the bottom portion to cause the cosmetic carrier and, hence, the lipstick to extend from the container for applying the lipstick and to retract into the container for storage.

It is particularly desirable to provide a lipstick container having an inner sleeve which may be effortlessly rotated within the outer sleeve but which has enough torque to feel sturdy. Drag may be created between concentrically arranged members to achieve the desired torque. The prior art includes several attempts at achieving the desired amount of torque, many of which experience significant shortcomings. For example, many are complicated, relatively expensive to manufacture, require exact tolerances, or experience wear over extended use thereby adversely effecting torque produced between the relatively rotating sleeves.

SUMMARY OF THE INVENTION

It is therefore an object of the present invention to provide a lipstick container which achieves the desired amount of torque between the concentric members of the container.

It is also an object of the present invention to provide the desired amount of torque with a design which is effective, can withstand extended use, and is easy to manufacture.

The present invention pertains to a cosmetic container having components for improving the smooth operation and the swivel torque of the cosmetic container when the bottom portion of the inner sleeve is rotated so as to extend or retract the lipstick within the container. This is achieved by the combination of the cosmetic carrier and the inner sleeve. The cosmetic container generally possesses concentrically arranged members including an outer sleeve defining at least one helical channel, an inner sleeve defining at least one axially extending longitudinal channel, and a cosmetic carrier having at least one outwardly extending lug. The carrier lug extends through the longitudinal channel of the inner sleeve and is received within the helical channel of the outer sleeve for extending and retracting the cosmetic carrier when the inner sleeve is rotated relative to the outer sleeve.

The inner sleeve according to the present invention preferably includes a pair of longitudinal channels and two longitudinally extending slots extending substantially the same length as the longitudinal channels of the inner sleeve and parallel thereto. The longitudinal slots are each defined by a pair of resilient, longitudinally extending, inner sleeve borders and preferably include upper and lower relief areas. The upper and lower relief areas extend perpendicular to the length of the slots. Preferably, the inner sleeve is formed of a resilient plastic material.

The cosmetic carrier preferably includes a pair of lugs and two radially outwardly extending protrusions. The carrier protrusions are configured to have a shape and size to be received within the upper and lower relief areas of the inner sleeve and to mate with the longitudinal slots. The carrier protrusions are annular and have a circumferential width which is greater than the width of the longitudinal slot as defined by the inner sleeve borders. Accordingly, when the carrier is concentrically positioned within the inner sleeve, at least a portion of the annular carrier protrusion is received within a respective longitudinal slot. Other portions of the face of the carrier protrusion engage the inner sleeve borders defining the longitudinal slots.

When the base of the inner sleeve is rotated, the cosmetic carrier lugs traverse the length of the helical channel of the outer sleeve and the length of the longitudinal channel of the inner sleeve as described above. The radially outwardly extending protrusions contact the inner sleeve borders defining the longitudinal slots. This thereby creates drag, resulting in increased torque.

When the cosmetic carrier is positioned at its uppermost or lowermost positions, the relief areas provide a region wherein the radially outwardly extending protrusions relax. The bottom edge of at least one of the relief areas is designed with a slight angle. The angled bottom edge of the relief area provides a region for the ribs to disengage from the edges thereby creating a lock.

BRIEF DESCRIPTION OF THE DRAWINGS

The foregoing and other objects, features, and advantages of the present invention will be made apparent from the following detailed description of the preferred embodiment of the invention and from the drawings, in which.

DETAILED DESCRIPTION

The present invention will now be described more fully with reference to the accompanying drawings, in which preferred embodiments of the invention are shown. This invention should not, however, be construed as limited to the embodiments set forth herein; rather, they are provided so that this disclosure will be thorough and complete and will fully convey the scope of the invention to those skilled in the art.

The present invention is shown and described herein as a container for applying cosmetics, such as lipstick. For the sake of brevity, the description which follows will refer to a lipstick container. However, it should be evident that the container has utility in various other areas wherein a product is to be extended from and retracted into a case. For instance, the container may be utilized for any product requiring topical application.

Figure 1:
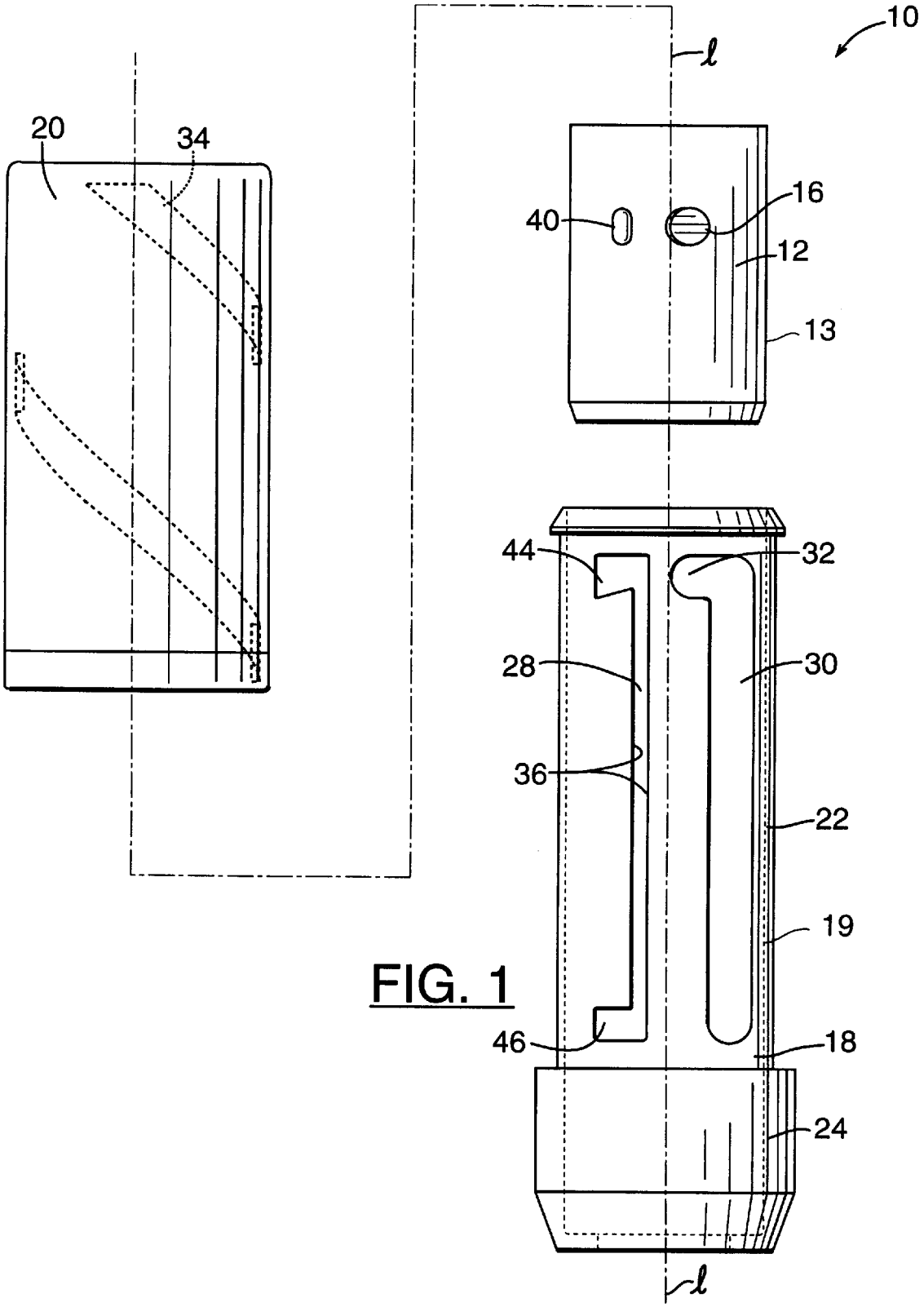
FIG. 1 is an exploded view of the cosmetic container according to a first embodiment of the present invention.
Figure 2:
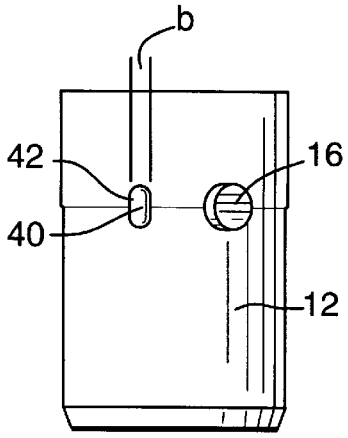
FIG. 2 illustrates the cosmetic carrier of the cosmetic container.
Figure 3:
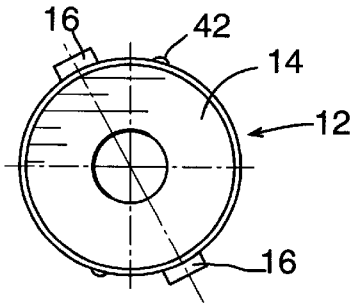
FIG. 3 is a top plan view of the cosmetic carrier.

The lipstick container of the present invention, indicated by the reference character 10, is designed for dispensing lipstick so that it may be cosmetically applied. The lipstick container 10 includes a plurality of tubular members which are concentrically arranged about the longitudinal axis l as best illustrated in FIG. 2. The tubular members include a cosmetic carrier 12 having a tubular sidewall 13 and defining a cosmetic receiving receptacle 14 for receiving the cosmetic therein. The cosmetic carrier 12 also includes at least one, and preferably a pair, of radially outwardly extending lugs 16. The cosmetic carrier 12 is concentrically positioned within an inner sleeve 18 having a tubular sidewall 19 and which, in turn, is concentrically positioned within an outer sleeve 20. The above-described members are preferably positioned within a protective cover (not shown) including a topshell and a baseshell.

The inner sleeve 18 and the outer sleeve 20 are preferably molded of a resilient material, such as plastic. The first and second embodiments of the present invention differ with respect to the inner sleeve. According to both embodiments, the inner sleeve 18 is defined substantially by a relatively thin-walled tubular upper portion 22 defined by a reduced diameter portion of the inner sleeve. A thicker walled body portion 24 is formed integrally with the lower end of the reduced diameter 22 and defines a base. The base portion 24 extends a distance below the outer sleeve 20 so as to provide a manually rotatable portion. Thus, the user may rotate the bottom portion 24 of the inner sleeve 18 to provide relative rotational movement between the inner sleeve 18 and the outer sleeve 20 so that the cosmetic carrier 12 may be extended or retracted to apply and store the lipstick.

The inner sleeve 18 according to both embodiments includes at least one longitudinal aperture in the form of either a longitudinal channel 30 or longitudinal slot 28. The inner sleeve 18 may include one or more longitudinal apertures in the form of a longitudinal slot 28 and/or longitudinal channel 30. Preferably, a pair of longitudinal slots 28 and a pair of longitudinal channels 30 are provided. The longitudinal aperture, be it a longitudinal 28 or channel 30, extends substantially along the length of the reduced diameter portion 22 of the inner sleeve 18.

According to the first embodiment of the present invention, illustrated in FIGS. 1–10, the longitudinal channels 30 are each provided with an upper laterally extending locking extension 32 which, as shown, is formed integrally with the respective longitudinal channel 30. The locking extensions 32 limit the movement of the cosmetic carrier 12 in the fully extended position. For instance, when the cosmetic carrier 12 is extended to its uppermost position, it is restrained from further upward movement because further rotational movement of the bottom base portion 24 of the inner sleeve 18 is prohibited. Likewise, when the lipstick within the cosmetic carrier 12 is fully retracted, further retraction is limited due to the retention of the lugs 16 between the sidewalls of the longitudinal channel 30.

The tubular outer sleeve 20 is positioned circumferentially around the tubular inner sleeve 18. The outer sleeve 20 defines at least one helical channel 34 formed on the inner surface thereof. Preferably, two helical channels 34 are provided. The helical channels 34 are each defined by opposing upper and lower sidewalls and are configured to receive a respective lug 16 of the cosmetic carrier 12 as shown in the various figures.

In operation, the lugs 16 of the cosmetic carrier 12 extend through the longitudinal channels 30 of the inner sleeve 18. The lugs 16 are thereby received within the helical channels 34 of the outer sleeve 20. Thus, when the bottom base portion 24 of the inner sleeve 18 is rotated so as to provide relative rotational movement between the inner sleeve 18 and the outer sleeve 20, the cosmetic carrier 12 is extended and retracted along the longitudinal axis l of the lipstick container 10. The cosmetic carrier 12 rotates with the inner sleeve 18 due, at least in part, to the pair of lugs 16 which extend through the longitudinal channels 30 of the inner sleeve 18. Upward and downward movement of the cosmetic carrier 12 relative to the inner sleeve 18 is, however, permitted. As the inner sleeve 18 rotates when torque is applied, the cosmetic carrier 12 extends and retracts as the lugs 16 traverse the length of the helical channels 34 of the outer sleeve 20.

The longitudinal slot 28 is also defined by the inner sleeve 18. The longitudinal slot 28 is defined by resilient inner sleeve borders 36. The inner sleeve borders 36 are resilient, particularly since the inner sleeve 18 is preferably formed of a resilient material such as a plastic. The cosmetic carrier 12 includes at least one radial protuberance which may be in the form of the carrier lug 16 or a radially outwardly extending radial protrusion 40. Preferably, the carrier 12 includes at least a pair of radial protrusions 40 and/or carrier lugs 16 and, more preferably, a pair of diametrically opposing radial protrusions 40 and a pair of diametrically opposing carrier lugs 16 as illustrated. The radial protrusions 40 are configured to cooperate with the longitudinal slots 28 and the carrier lugs 16 are configured to cooperate with the longitudinal channels 30. The cooperation of the carrier lugs 16 with the longitudinal channels 30 have been discussed above.

The desired torque is created by the combination of the cosmetic carrier 12 and the tubular inner sleeve 18. Drag results from the interaction of the radial protrusions 40 with the respective longitudinal slots 28. The longitudinal slot 28 has a width a, (see FIG. 4) measured in the circumferential direction, defined between the inner sleeve borders 36. The radial protrusions 40 have a width b measured in the circumferential direction which is greater than the width a of the longitudinal slot 28. The radial protrusions 40 include an outwardly extending face 42 which, preferably, is annular. Accordingly, only a portion of the face 42 extends within the longitudinal slot 28 and other portions thereof frictionally mate with the inner sleeve borders 36 to create drag.

The tubular inner sleeve 18 also defines upper relief areas 44 and lower relief areas 46 adjacent the ends of the longitudinal slots 28. It is within the scope of the present invention for only one relief area 44 or 46 to be provided with each longitudinal slot but, preferably, both are provided. Also, preferably, the relief areas 44,46 extend in the same direction transverse to the longitudinal axis, that is, perpendicular to the longitudinal slot 28. Alternatively, the relief areas 44,46 may extend on opposing sides of the longitudinal slot 28. As illustrated, the upper relief area 44 is defined by an angled bottom wall 48.

Figure 4:
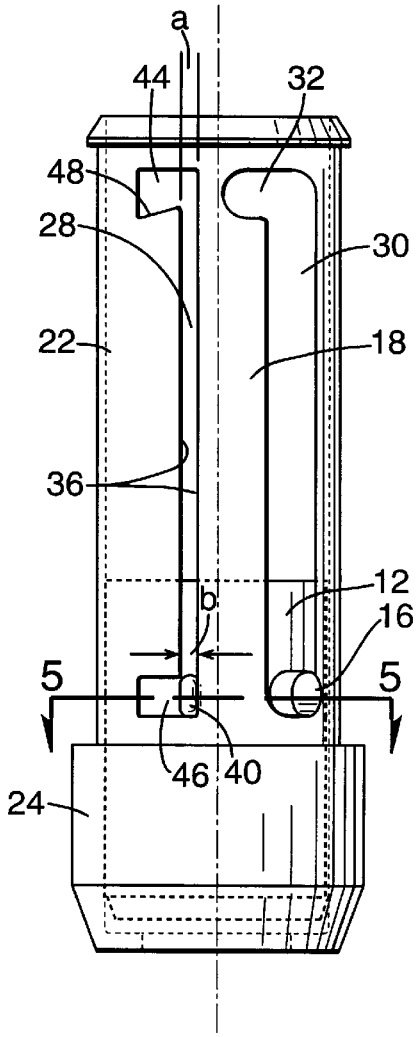
FIG. 4 illustrates the inner sleeve with the cosmetic carrier in the fully retracted position.
Figure 5:
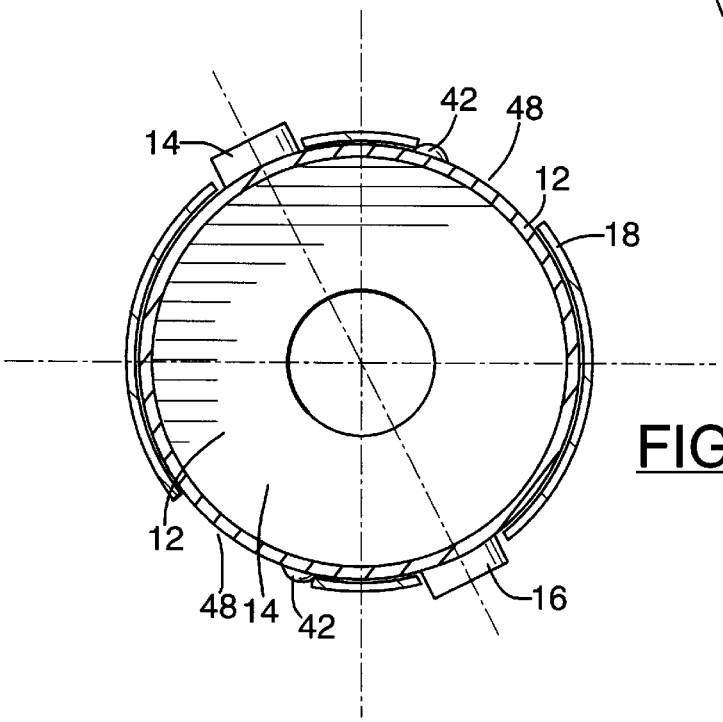
FIG. 5 is a cross-sectional view taken along line 5—5 of FIG. 4.
Figure 8:
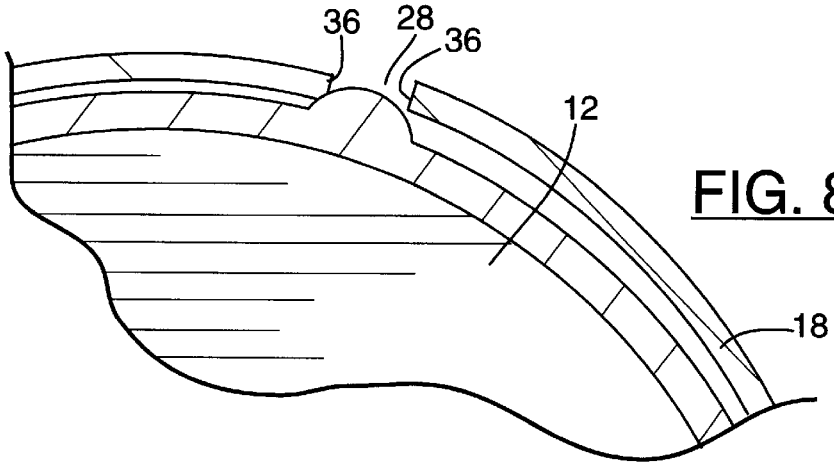
FIG. 8 is an enlarged sectional view of a portion of FIG. 7.
Figure 7:
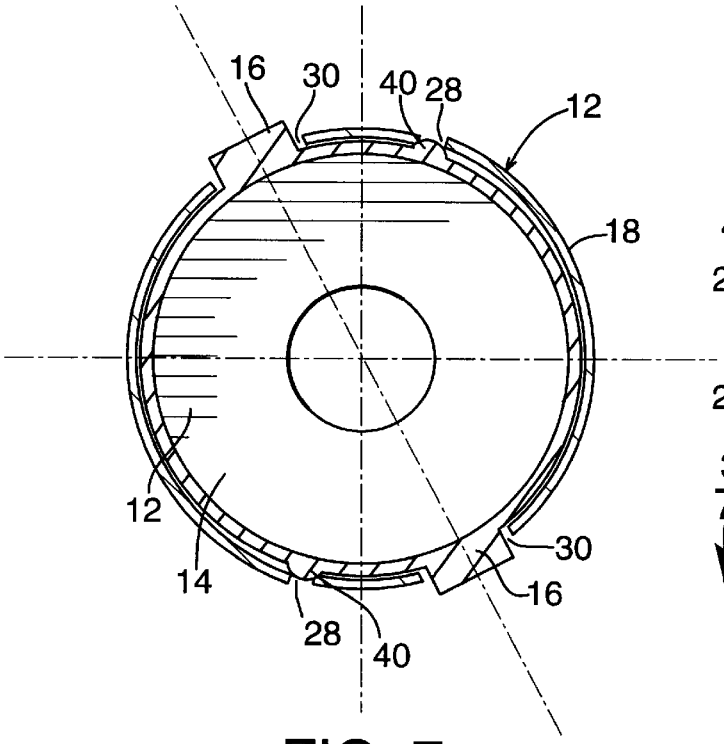
FIG. 7 is a cross-sectional view taken along line 7—7 of FIG. 6.
Figure 6:
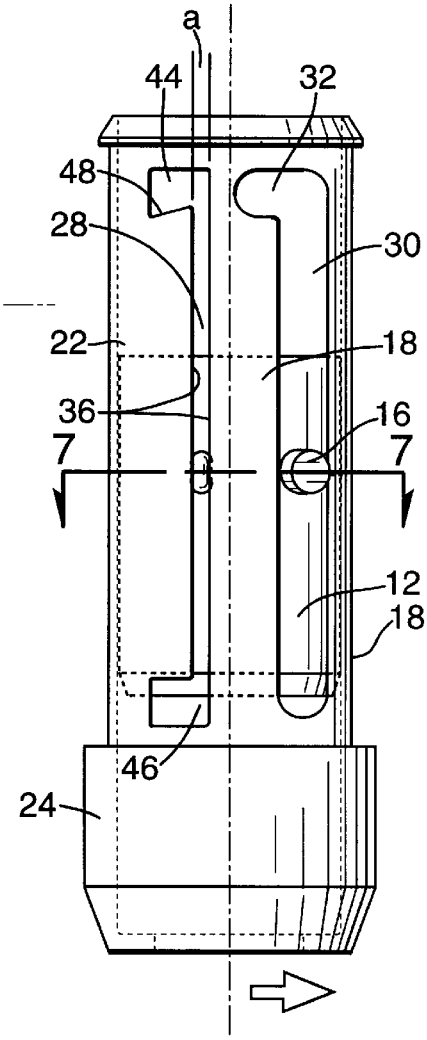
FIG. 6 illustrates the inner sleeve with the cosmetic carrier between the fully extended and fully retracted positions.
Figure 10:
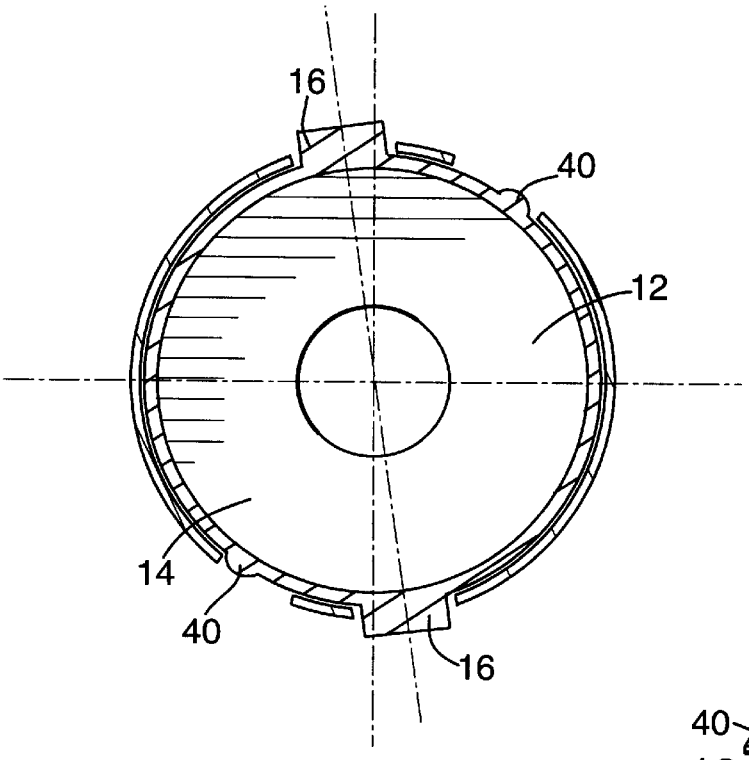
FIG. 10 is a cross-sectional view taken along line 10—10 of FIG. 9.
Figure 9:
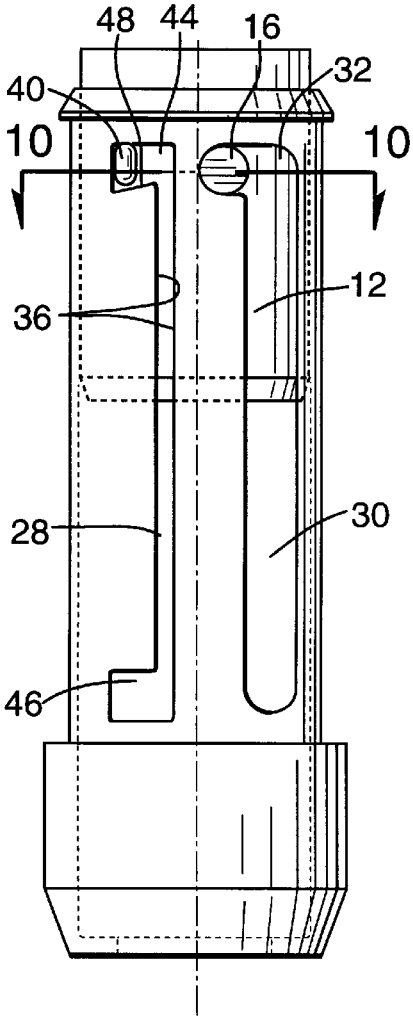
FIG. 9 illustrates the inner sleeve and the cosmetic carrier, with the cosmetic carrier being in the fully extended position.

The cosmetic carrier is thereby movable between a fully retracted position as represented in FIGS. 4 and 5, to a fully extended position as represented in FIGS. 9 and 10. FIGS. 6 and 7 represent the intermediate position, that is when the cosmetic carrier is between the fully extended and the fully retracted positions.

When the cosmetic carrier 12 is in the fully retracted position, the carrier lug 16 is received within the lower portion of the respective longitudinal channel 30 and further rotation of the base 24 in the same direction is prohibited. At least a portion of the radial protrusion 40 is positioned within the lower relief area 46.

The relief areas 44,46 have a width measured in the circumferential direction which is greater than the width b of the radial protrusion 40. Preferably, the relief areas 44,46 also have a height, measured in a direction parallel to the longitudinal axis, which is greater than the height of the radial protrusion 40, measured in a direction parallel to the longitudinal axis. The height of at least the upper relief area 44 is at least greater than the height of the radial protrusion 40 in the area of its greatest height as defined by the angled bottom wall 48. This allows the radial protrusions 40 to relax within the relief area 44 adding to the useful life of the cosmetic container 10. The lower relief area 46 permits the radial protrusion 40 to disengage from the inner sleeve borders 36 of the longitudinal slot 28 enabling it to relax.

As represented in FIGS. 4 and 5, both the outwardly extending lug 16 and the radial protrusion 40 are in a locked, fully retracted position. Force sufficient to turn the base 24 of the inner sleeve 18 in the opposite direction is required to engage the radial protrusion 40 with the inner sleeve borders 36 of the longitudinal slot 28. This thus provides a noticeable lock of the cosmetic carrier within the inner sleeve. A "click" may sound providing audible indication in addition to the tactile indication. Unintentional extension, such as when the topshell of the container 10 is positioned upon the baseshell, is thereby limited.

As the base 24 is rotated in the direction of the arrow represented in FIG. 6, for example, sufficient force is required to engage the radial protrusion 40 with the inner sleeve borders 36 to permit the cosmetic carrier 12 to rise as the carrier lug 16 traverses the length of the helical channels 34 of the tubular outer sleeve 20. As illustrated, the carrier lugs 16 extend through the longitudinal channels 30. In contrast, the radial protrusions do not extend substantially through the longitudinal slots 28 but, rather, only a portion of the annular faces 42 extend through the respective longitudinal slot 28 defined between the resilient inner sleeve borders 36. This is best represented in FIG. 7. As shown, a portion of each annular face 42 of the radial protrusions 40 engages the inner sleeve borders 36 so as to provide drag to thereby increase the torque necessary to raise the cosmetic carrier 12.

As the cosmetic carrier reaches the fully extended position, as represented by FIG. 9, the cosmetic carrier lug 16 is received within the upper locking extension 32. The radial protrusion 40 is received within the upper relief area 44 and when in the position represented in FIGS. 9 and 10, the radial protrusion 40 substantially fully relaxes therein. Additional rotational force may be applied to the base 24, but such force must be sufficient to overcome the inclined surface of the angled bottom wall 48 of the upper relief area 44 to retract the cosmetic. This thereby prevents unintentional retraction of the cosmetic carrier 12 within the inner sleeve 18, such as when the lipstick is being applied. As represented in FIG. 10, the radial protrusion 20 which is formed of a resilient material, is thereby permitted to relax, that is, relax from its compressed state between the fully extended and fully protected positions, to prolong the life of the cosmetic container 10.

Figure 11:
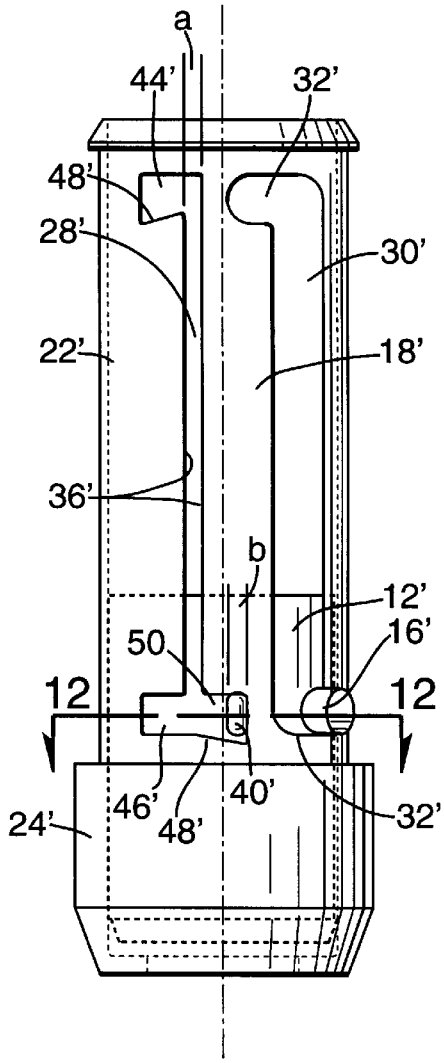
FIG. 11 illustrates an inner sleeve according to a second embodiment of the present invention.
Figure 12:
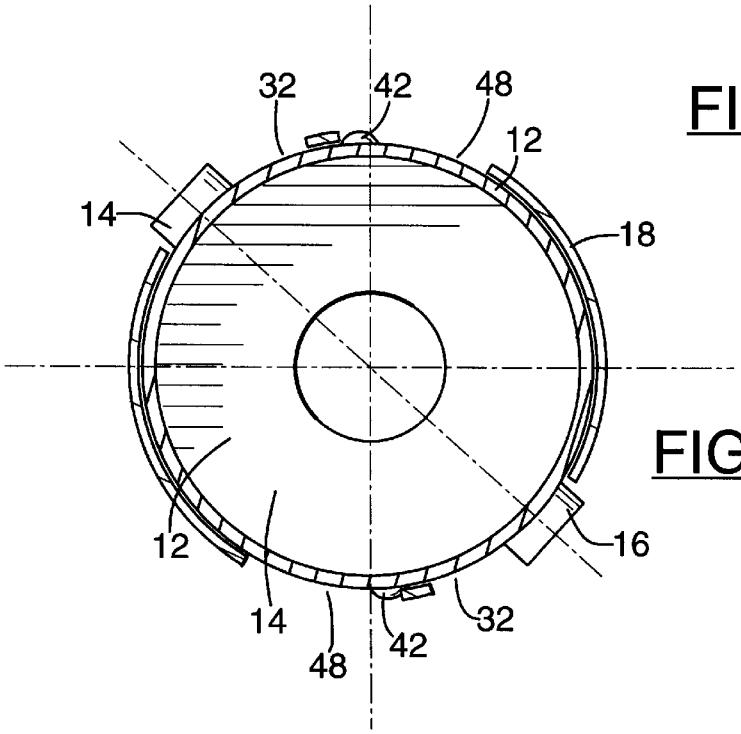
FIG. 12 is a cross-sectional view taken along line 12—12 of FIG. 11.

An inner sleeve 18' according to a second embodiment of the present invention is represented in FIGS. 11 and 12. Reference numbers in connection with this embodiment are used for similar members of the first embodiment, but with prime designations. This embodiment differs from the first embodiment with respect to the lower portions of the longitudinal channel 30' and the longitudinal slot 28'. With respect to the longitudinal slot 28', the lower relief area 46' is differently configured. The lower relief area 46' extends perpendicular to the longitudinal slot 28', on both sides thereof. On one side of the longitudinal slot 28', the lower relief area 46' includes an angled bottom wall 48'. The longitudinal channel 30' differs in that it includes a lower locking extension 32'. Accordingly, the lug 16' of the cosmetic carrier 12' is received within the lower locking extension 32' when the cosmetic carrier 12' is fully retracted.

When the cosmetic carrier 12' is retracted so that the carrier lug 16' is positioned adjacent the bottom of the longitudinal channel 30', the radial protrusion 40' relaxes due to the presence of the lower relief area 46'. When the cosmetic carrier is further rotated wherein the carrier lug 16' is received within the lower locking extension 32', as best represented in FIG. 12, the radial protrusion 40' is received within the portion of the lower relief area 46' extending in a direction opposite that of the upper relief area 44'. The radial protrusion 40' is therefore substantially relaxed within the lower relief area 46'. Preferably, the lower relief area 46' includes an angled bottom wall 48' similar to the upper relief area 44'.

While particular embodiments of the invention have been described, it will be understood, of course, the invention is not limited thereto since modifications may be made by those skilled in the art, particularly in light of the foregoing teachings. It is therefore, contemplated by the appended claims to cover any such modifications that incorporate those features of these improvements in the true spirit and scope of the invention.

That which is claimed:

1. A cosmetic container for dispensing a cosmetic comprising:

at least one tubular sleeve having a longitudinal axis, said sleeve defining at least one longitudinal aperture having a first width measured in a circumferential direction; and a cosmetic carrier concentrically positioned within said at least one tubular sleeve and being movable therein from a fully extended position to a fully retracted position along the longitudinal axis of said inner sleeve, said cosmetic carrier comprising a tubular sidewall and at least one radial protuberance cooperating with said at least one longitudinal aperture extending radially outwardly from said sidewall, said at least one radial protuberance having a second width measured in the circumferential direction, said radial protuberance second width being greater than said longitudinal aperture first width so that said at least one radial protuberance frictionally engages said at least one longitudinal aperture for achieving desired torque between said at least one tubular sleeve and said cosmetic carrier when said cosmetic carrier is moved along the longitudinal axis of said at least one tubular sleeve between said fully extended and fully retracted positions.

2. A cosmetic container according to claim 1 wherein said at least one radial protuberance is a radial protrusion and said at least one tubular sleeve also defines at least one relief area which extends substantially perpendicular to an upper or lower end of said at least one longitudinal aperture and which opens to said at least one longitudinal aperture, said at least one relief area having a height, measured in the direction parallel to the longitudinal axis, which is substantially greater than the height of said at least one radial protrusion also measured in the direction parallel to the longitudinal axis and said at least one relief area has a third width measured in the circumferential direction, said third width being substantially greater than said radial protrusion second width so as to receive said at least one radial protrusion in said fully extended or fully retracted position so that said at least one radial protrusion substantially relaxes therein.

3. A cosmetic container according to claim 2 wherein said at least one tubular sleeve defines an upper relief area configured to receive said at least one radial protrusion in the fully extended positions.

4. A cosmetic container according to claim 3 wherein said at least one tubular sleeve also defines a lower relief area configured to receive at least a portion of said at least one radial protrusion in the fully retracted position.

5. A cosmetic container according to claim 4 wherein said lower relief area extends on opposing sides of said at least one longitudinal aperture.

6. A cosmetic container according to claim 4 wherein each of said upper and lower relief areas is defined by an aperture of said at least one tubular sleeve having an angled bottom wall.

7. A cosmetic container according to claim 2 wherein said at least one relief area is defined by an aperture of said at least one tubular sleeve having an angled bottom wall.

8. A cosmetic container according to claim 1 wherein said at least one longitudinal aperture is a longitudinal slot defined by resilient, longitudinally extending, sleeve sidewall borders and said at least one radial protuberance is a radial protrusion which includes an annular face and only a portion of said annular face is received within said at least one longitudinal slot so that other portions of said annular face engage said sidewall borders.

9. A cosmetic container according to claim 8 wherein said at least one tubular sleeve is a tubular inner sleeve and said cosmetic container further comprises a tubular outer sleeve including a helical channel extending along an inner periphery thereof, said tubular inner sleeve being concentrically positioned within said tubular outer sleeve.

10. A cosmetic container according to claim 9 wherein said inner sleeve further defines a longitudinal channel and said cosmetic carrier includes at least one radially, outwardly extending lug configured to be received within said longitudinal channel of said tubular inner sleeve and said helical channel of said tubular outer sleeve to propel and retract cosmetic housed therein.

11. A cosmetic container according to claim 10 wherein said inner sleeve includes a base and a reduced diameter portion and said at least one longitudinal channel and said at least one longitudinal slot extend substantially along the length of said reduced diameter portion.

12. A cosmetic container according to claim 8 wherein said at least one tubular sleeve also defines at least one longitudinal channel and said cosmetic carrier includes at least one radially, outwardly extending lug configured to be received within said longitudinal channel to propel and retract cosmetic housed therein.

13. A cosmetic container according to claim 12 wherein said at least one tubular sleeve defines a pair of said longitudinal channels and said cosmetic carrier includes a pair of said radially, outwardly extending lugs for cooperating with said longitudinal channels.

14. A cosmetic container according to claim 13 wherein said at least one tubular sleeve defines a pair of said longitudinal slots and said cosmetic carrier includes a pair of said radial protrusions for cooperating with said longitudinal slots.

15. A cosmetic container according to claim 1 wherein said at least one tubular sleeve includes a base and a reduced diameter portion and said at least longitudinal aperture extends substantially along the length of said reduced diameter portion.

16. A cosmetic container for dispensing a cosmetic comprising:

at least one tubular sleeve having a longitudinal axis, said sleeve defining at least one longitudinal channel and at least one longitudinal slot, said longitudinal slot having a first width measured in a circumferential direction; and a cosmetic carrier concentrically positioned within said at least one tubular sleeve and being movable therein along the longitudinal axis of said at least one tubular sleeve, said cosmetic carrier comprising a tubular sidewall, at least one radial protrusion extending radially outwardly from said sidewall for cooperating with said at least one longitudinal slot, and at least one radially outwardly extending lug, said at least one lug being configured to be received within said at least one longitudinal channel and said at least one radial protrusion having a second width measured in the circumferential direction which is greater than said at least one longitudinal slot first width for cooperating with said longitudinal slot for achieving desired torque between said at least one tubular sleeve and said cosmetic carrier when said cosmetic carrier is moved along the longitudinal axis of said at least one tubular sleeve.

17. A cosmetic container according to claim 16 wherein said at least one tubular sleeve defines a pair of said longitudinal channels and said cosmetic carrier includes a pair of said radially, outwardly extending lugs for cooperating with said longitudinal channels.

18. A cosmetic container according to claim 16 wherein said at least one tubular sleeve defines a pair of said longitudinal slots and said cosmetic carrier includes a pair of said radial protrusions for cooperating with said longitudinal slots.

19. A cosmetic container according to claim 16 wherein said at least one tubular sleeve also defines at least one relief area which extends substantially perpendicular to an upper or lower end of said at least one longitudinal slot and which opens to said at least one longitudinal slot, said at least one relief area having a height, measured in the direction parallel to the longitudinal axis, which is greater than the height of said at least one radial protrusion also measured in the direction parallel to the longitudinal axis and said at least one relief area has a third width measured in the circumferential direction, said third width being substantially greater than said radial protrusion second width so as to receive said at least one radial protrusion in said fully extended or fully retracted position so that said at least one radial protrusion substantially relaxes therein.

20. A cosmetic container according to claim 19 wherein said at least one relief area is defined by an aperture of said at least one tubular sleeve having an angled bottom wall.

21. A cosmetic container according to claim 19 wherein said at least one tubular sleeve defines an upper and lower relief area.

22. A cosmetic container according to claim 16 wherein said longitudinal slot is defined by resilient, longitudinally extending, sleeve borders and said at least one radial protuberance is a radial protrusion which includes an annular face and only a portion of said annular face is received within said at least one longitudinal slot so that other portions of said annular face engage said sleeve borders.

23. An inner sleeve for a cosmetic container comprising an annular sidewall defining a pair of diametrically opposing, longitudinally extending channels and at least one longitudinal slot, said channels each including an upper locking channel extending substantially perpendicular to said longitudinal channel and said at least one longitudinal slot including upper and lower relief areas which extend substantially perpendicular thereto, at least one of said upper and lower relief areas including an inclined lower edge for defining an increased area of said relief area.

* * * * *